US009617738B2

(12) United States Patent
Suzuki

(10) Patent No.: US 9,617,738 B2
(45) Date of Patent: Apr. 11, 2017

(54) AUXILIARY SECURING SUPPORT AND METHOD OF INSTALLING THE SAME

(71) Applicant: Nichiha Corporation, Nagoya-shi, Aichi (JP)

(72) Inventor: Kenji Suzuki, Nagoya (JP)

(73) Assignee: NICHIHA CORPORATION, Nagoya-Shi (JP)

( * ) Notice: Subject to any disclaimer, the term of this patent is extended or adjusted under 35 U.S.C. 154(b) by 0 days.

(21) Appl. No.: 14/926,198

(22) Filed: Oct. 29, 2015

(65) Prior Publication Data

US 2016/0289976 A1 Oct. 6, 2016

(30) Foreign Application Priority Data

Mar. 31, 2015 (JP) ..... 2015-071644

(51) Int. Cl.
*E04F 13/07* (2006.01)
*E04F 13/08* (2006.01)
*E04F 13/00* (2006.01)

(52) U.S. Cl.
CPC ..... *E04F 13/0826* (2013.01); *E04F 13/007* (2013.01)

(58) Field of Classification Search
CPC . E04F 13/0803; E04F 13/081; E04F 13/0812; E04F 13/0814; E04F 13/0821; E04F 13/0822; E04F 13/0828
See application file for complete search history.

(56) References Cited

U.S. PATENT DOCUMENTS 6,315,489 B1 * 11/2001 Watanabe ..... E04F 13/0846 248/220.21

FOREIGN PATENT DOCUMENTS

JP 3867719 B2 1/2007

* cited by examiner

*Primary Examiner* — Patrick Maestri
(74) *Attorney, Agent, or Firm* — Birch, Stewart, Kolasch & Birch, LLP

(57) ABSTRACT

An auxiliary securing support for attaching an exterior wall material to a building frame having a plurality of vertical frame members through a securing member includes a main body and a protrusion. The main body has an elongated shape, includes a planar portion to which the securing member is fixable, and is fixable to at least one of the vertical frame members. The protrusion protrudes in a direction crossing the planar portion so as to come into contact with an upper side portion of the exterior wall material and that has a length such that the protrusion is not exposed on an external surface of the exterior wall material.

18 Claims, 10 Drawing Sheets

AUXILIARY SECURING SUPPORT AND METHOD OF INSTALLING THE SAME

CROSS REFERENCE TO RELATED APPLICATIONS

This application is based on Japanese Patent Application No. 2015-071644 filed in the Japanese Patent Office on Mar. 31, 2015, the entire contents of which are hereby incorporated by reference.

BACKGROUND OF THE INVENTION

1. Field of the Invention

The present invention relates to an auxiliary securing support that is used to attach an exterior wall material to a building frame and a method of installing the auxiliary securing support.

2. Description of the Related Art

Japanese Patent No. 3867719 describes a securing member and an auxiliary securing support. The securing member is used to engage adjacent exterior wall materials at a joint in a case where the joint is located in a region in which a column or a stud is not disposed. The auxiliary securing support, which has an elongated shape, is used to fix the securing member to a column or a stud of a building frame. By using the securing member and the auxiliary securing support, even if a joint of exterior wall materials is located between a column and a stud, it is possible to fix the exterior wall material in place at the joint. With the technology disclosed in Japanese Patent No. 3867719, the securing member, which has a length less than that of the auxiliary securing support, receives an external force (such as wind pressure) applied from the exterior wall material. Therefore, a load applied to the auxiliary securing support can be reduced, and thereby the durability of the auxiliary securing support can be improved.

In a case where a joint of exterior wall materials is located in a region in which a column or a stud of the building frame is not disposed, the exterior wall materials are fixed to a building frame as follows. First, at an upper end portion of the exterior wall material, which is located below an auxiliary securing support, the auxiliary securing support is disposed across the joint and along the back surface of the exterior wall materials. Second, the auxiliary securing support is fixed to a column or a stud that is located near the joint by using a screw or a nail.

Third, a securing member is made to engage with an upper end portion of the joint of the exterior wall materials. Fourth, in this state, the securing member is fixed to the auxiliary securing support by using a screw or a nail. Thus, the exterior wall materials, whose joint is located in a region in which a column or a stud is not disposed, are indirectly fixed to the column or the stud near the joint also at the joint.

SUMMARY OF THE INVENTION

Because the auxiliary securing support described in Japanese Patent No. 3867719 has an elongated shape, it is not easy to horizontally attach the auxiliary securing support to a column or a stud. Moreover, because a gap is formed between an exterior wall material and a column or a stud in consideration of ventilation and rainwater drainage, when attaching the auxiliary securing support to a column or a stud, it is necessary to be careful not to drop the auxiliary securing support into the gap. As a result, the workability of the auxiliary securing support has room for improvement.

An object of the present invention, which has been made against the background described above, is to provide an auxiliary securing support with which workability can be improved and a method of installing the auxiliary securing support.

According to the present invention, there is provided an auxiliary securing support for attaching an exterior wall material to a building frame having a plurality of vertical frame members through a securing member. The auxiliary securing support includes a main body that has an elongated shape, that includes a planar portion to which the securing member is fixable, and that is fixable to at least one of the vertical frame members; and a protrusion that protrudes in a direction crossing the planar portion so as to come into contact with an upper side portion of the exterior wall material and that has a length such that the protrusion is not exposed on an external surface of the exterior wall material.

With the present invention, the workability of the auxiliary securing support can be improved.

DESCRIPTION OF THE EMBODIMENT

Figure 1:
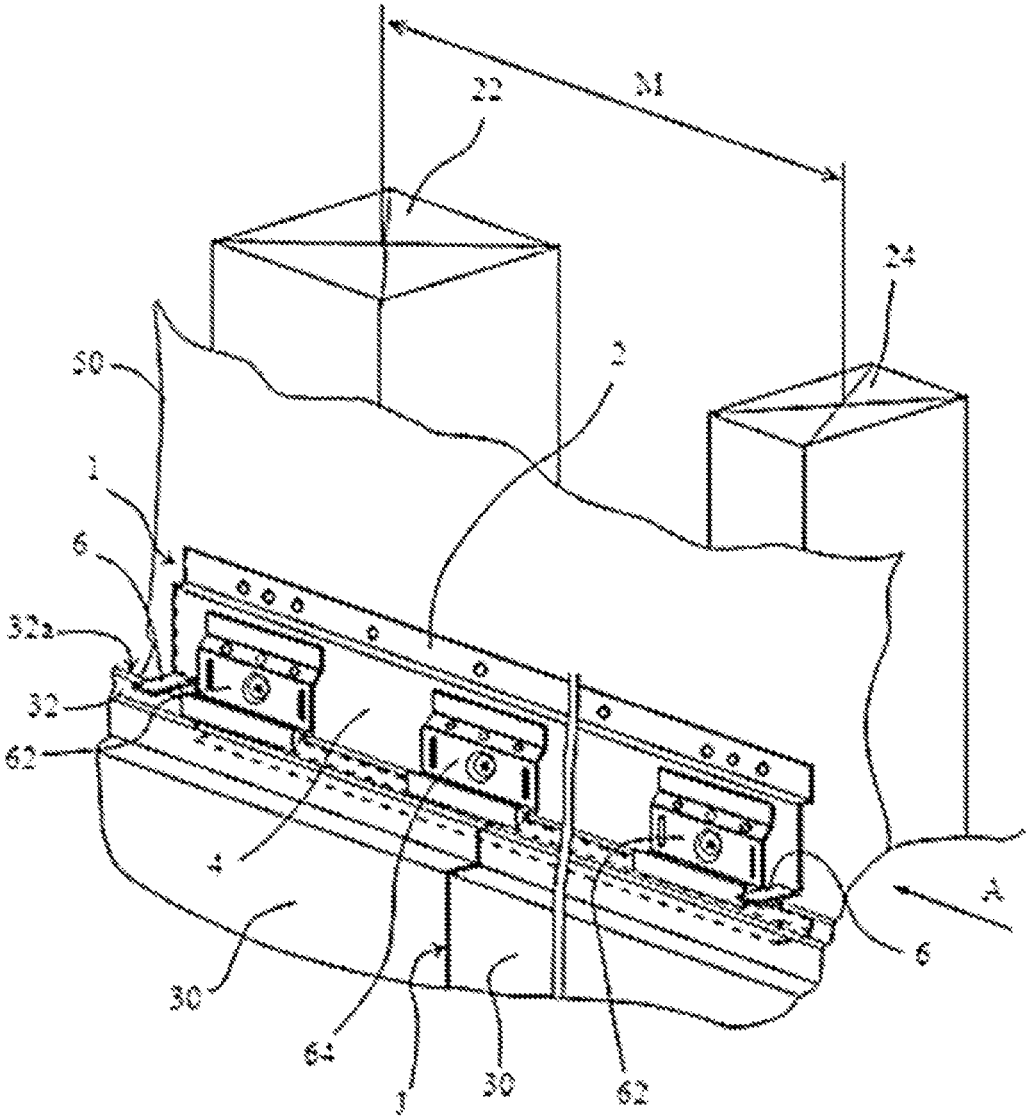
FIG. 1 is a perspective view illustrating the structure of an auxiliary securing support according to an embodiment of the present invention.

To achieve the aforementioned object, an auxiliary securing support according to an aspect is provided.

According to an aspect, an auxiliary securing support is capable of indirectly attaching a joint between adjacent exterior wall materials to a vertical frame member through a securing member in a case where the joint is located in a region of a building frame in which the vertical frame member is not disposed. The auxiliary securing support includes a main body that has an elongated shape, that includes a planar portion to which the securing member is fixable, and that is fixable to the vertical frame member; and a protrusion that protrudes in a direction crossing the main body so as to be in contact with an upper side portion of the exterior wall material, which is disposed on an upper side of the exterior wall material in a vertical direction, when the exterior wall material is fixed to the vertical frame member.

The term "vertical frame member", which typically refers to a column or a stud, also refers to a furring strip that is attached and fixed to a column or a stud. The term "region in which the vertical frame member is not disposed" refers to a region between columns, between a column and a stud, or between studs.

With the present aspect, it is possible to perform an operation of fixing the auxiliary securing support to the vertical frame member in a state in which the protrusion is in contact with the upper side portion of the exterior wall material, that is, in a state in which the auxiliary securing support is temporarily placed on the upper side portion of the exterior wall material. Therefore, it is possible to horizontally hold the auxiliary securing support easily. Moreover, it is possible to efficiently prevent dropping of the auxiliary securing support into a gap between the vertical frame member (such as a column, a stud, or a furring strip) and the exterior wall material, which is formed in consideration of ventilation and rainwater drainage. As a result, the workability of the auxiliary securing support is improved.

According to a second aspect, the auxiliary securing support includes a plurality of the protrusions.

With the second aspect, it is possible to more stably place the auxiliary securing support on the upper side portion of the exterior wall material. Thus, it is possible to horizontally hold the auxiliary securing support more reliably.

According to a third aspect, in the auxiliary securing support, at least one of the protrusions is disposed on each of two end portions of the main body in the longitudinal direction.

With the third aspect, it is possible to realize a structure that enables the auxiliary securing support to be temporarily placed on the upper side portion of the exterior wall material stably by using a small number of the protrusions.

According to a fourth aspect, in the auxiliary securing support, the protrusion is formed by cutting and bending up a part of a lower end portion of the main body.

With the fourth aspect, it is possible to form the protrusion easily.

According to a fifth aspect, in the auxiliary securing support, the main body includes a first flat portion that comes into contact with the vertical frame member, a second flat portion that includes the planar portion and that is disposed parallel to the first flat portion, and a connection portion that connects the first and second flat portions in a step-like shape. The connection portion is structured so that the second flat portion is located away from the first flat portion in a direction that is the same as a protruding direction of the protrusion. The protrusion is provided on the second flat portion.

With the fifth aspect, because the auxiliary securing support has a step-like shape, it is possible to secure the exterior wall material to the vertical frame member in a state in which a clearance is provided between the exterior wall material and the vertical frame member. Thus, it is possible to improve ventilation and rainwater drainage.

According to a sixth aspect, in the auxiliary securing support, the protrusion is engageable with the upper side portion of the exterior wall material.

With the sixth aspect, it is possible to effectively prevent forward leaning of the auxiliary securing support that is temporarily placed on the upper side portion of the exterior wall material. Thus, it is possible to temporarily place the auxiliary securing support on the upper side portion of the exterior wall material more stably, and the workability is further improved.

According to a seventh aspect, in the auxiliary securing support, the upper side portion includes a horizontal surface portion having a flat surface that extends substantially horizontally when the exterior wall material is attached to the vertical frame member and an inclined surface portion having a surface that is inclined with respect to the horizontal surface portion. The protrusion includes a contact portion that comes into contact with the horizontal surface portion and an engagement portion that is capable of engaging the inclined surface portion. An included angle between the contact portion and the engagement portion is greater than an included angle between the horizontal surface portion and the inclined surface portion.

With the seventh aspect, it is possible to effectively prevent insufficient engagement between the engagement portion and the exterior wall material while effectively preventing forward leaning of the exterior wall material.

According to an eighth aspect, in the auxiliary securing support, the engagement portion is formed by bending a part of the contact portion downward.

With the eighth aspect, it is possible to easily form the engagement portion.

According to an aspect, a method of installing an auxiliary securing support is used to indirectly fix a joint between adjacent exterior wall materials to a vertical frame member of a building frame through a securing member, the joint being located in a region of the building frame in which the vertical frame member is not disposed. The method includes preparing the auxiliary securing support according to any one of the above aspects; temporarily placing the auxiliary securing support so that the protrusion is in contact with the upper side portion of the exterior wall material, which is disposed on the upper side of the exterior wall material arranged to the vertical frame member; adjusting a position of the auxiliary securing support in a horizontal direction so that the main body is located at a position at which the auxiliary securing support extends across the joint of the exterior wall materials; and fixing the auxiliary securing support to the vertical frame member by using a fastening member.

With the method of installing an auxiliary securing support according to the present aspect, because the auxiliary securing support according to any one of the above aspects is used, it is possible to improve workability when fixing the auxiliary securing support to the vertical frame member.

Next, an embodiment of the present invention will be described.

Embodiment

Figure 3:
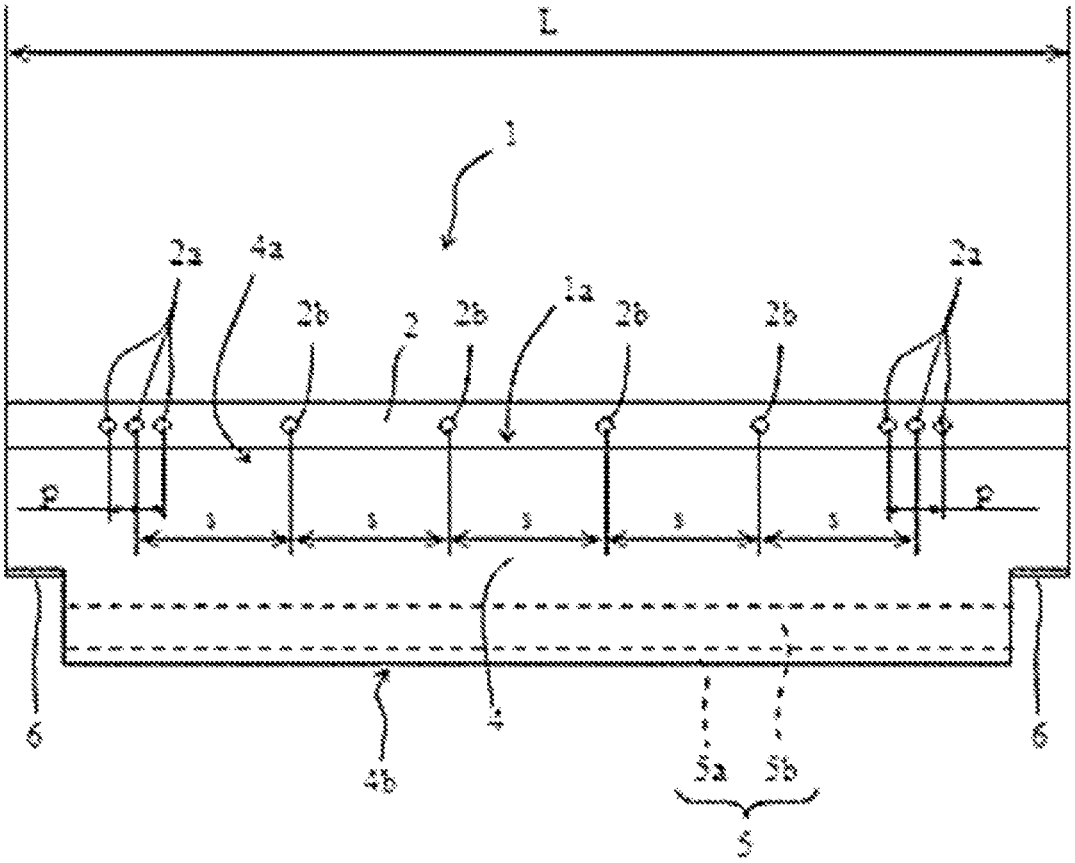
FIG. 3 is a side view illustrating the auxiliary securing support according to the embodiment of the present invention.

An auxiliary securing support 1, which is an "auxiliary securing support" according to the present embodiment, is made, for example, by bending an elongated steel sheet, such as a corrosion-resistant steel sheet, having a thickness in the range of about 0.8 mm to about 1.2 mm. Referring to FIGS. 1 and 3, the length L (horizontal width) of the auxiliary securing support 1 is greater than an interval M (for example, about 500 mm) between a column 22 and a stud 24 described below.

Figure 2:
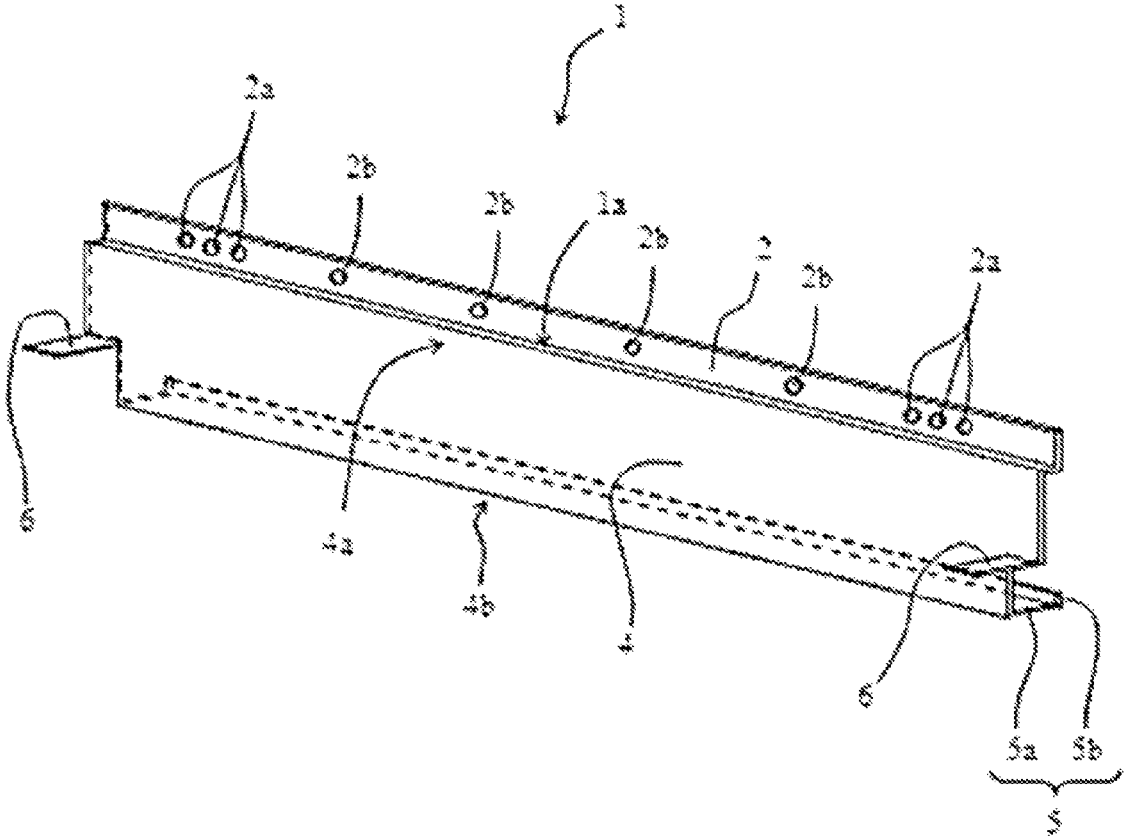
FIG. 2 is a front view illustrating the auxiliary securing support according to the embodiment of the present invention.

Referring to FIGS. 1 to 3, the auxiliary securing support 1 includes a contact flat portion 2, a main flat portion 4, and protruding pieces 6. The contact flat portion 2 comes into contact with the column 22 and the stud 24 described below. The main flat portion 4 is continuous with the contact flat portion 2 through a stepped portion 1*a*. The protruding pieces 6 protrude in a direction perpendicular to the main flat portion 4. The contact flat portion 2 and the main flat portion 4 constitute an example of a "main body", the contact flat portion 2 is an example of a "first flat portion", and the main flat portion 4 is an example of a "second flat portion". The stepped portion 1*a* is an example of a "connection portion", and the protruding pieces 6 are each an example of a "protrusion".

Referring to FIGS. 1 and 2, a plurality of holes 2*a* and 2*b* are formed in the contact flat portion 2 so as to be arranged in the longitudinal direction. A group of three consecutive holes 2*a*, which are spaced at regular intervals p (each being, for example, in the range of about 10 mm to about 15 mm), is formed in each of two end portions of the contact flat portion 2. The holes 2*b*, which are spaced at regular intervals s (each being, for example, in the range of about 50 mm to about 150 mm), are formed in a region of the contact flat portion 2 between the groups of holes 2*a*, which are disposed in the end portions of the contact flat portion 2. The interval p is less than the interval s. The interval between the middle one of the three holes 2*a* and one of the holes 2*b* that is adjacent to one of the three holes 2*a* that is nearest to the center of the contact flat portion 2 in the longitudinal direction is the same as the interval s between the holes 2*b*. By forming the three holes 2*a* consecutively at the intervals p, it is possible to use the auxiliary securing support 1 of a single type in various districts, even if the interval between the column 22 and the stud 24 differs between districts.

Referring to FIG. 3, the main flat portion 4 includes a bent portion 5 that is formed by bending a lower end portion 4*b*. The lower end portion 4*b* is on a side of the main flat portion 4 opposite to a side on which an upper end portion 4*a*, which is connected to the stepped portion 1*a*, is disposed. The bent portion 5 includes a first bent portion 5*a* and a second bent portion 5*b*. The first bent portion 5*a* is bent at right angles in the protruding direction of the protruding pieces 6 (leftward in FIG. 4). The second bent portion 5*b* is further bent at right angles from the first bent portion 5*a* toward the stepped portion 1*a*. The bent portion 5 is structured so that the second bent portion 5*b* is disposed in the same plane as the contact flat portion 2.

Referring to FIGS. 1 to 5, the protruding pieces 6 are formed by slitting corners at both ends of the main flat portion 4 adjacent to the lower end portion 4*b*, and bending up the corner portions. The protruding amount D of each protruding piece 6 is greater than the step height x of a metal securing member 64 (see FIGS. 5 and 6) described below and is less than the sum of the thickness t of a lower shiplap portion 32 described below and the step height x of the metal securing member 64 (see FIG. 5). That is, the tip of the protruding piece 6 is not exposed on the external surface of an exterior wall material 30, so that the esthetic appearance of the exterior wall material 30 is not impaired.

Next, installation of the exterior wall material 30 by using the auxiliary securing support 1, which is structured as described above, will be described. In particular, referring to FIG. 1, a method of fixing a left-right joint J of the exterior wall material 30, which is disposed between the column 22 and the stud 24, will be described. The column 22 and the stud 24 are spaced at the interval M (for example, 500 mm as meter module). In the present embodiment, horizontal installation, with which the exterior wall material 30 is installed so that the longitudinal direction of the exterior wall material 30 coincides with the horizontal direction, will be described. The left-right joint J is an example of a "joint".

Hereinafter, for convenience of description, the upward direction in the plane of FIG. 4 will be referred to as "upward" or "upper side", and the downward direction in the plane of FIG. 4 will be referred to as "downward" or "lower side". The direction toward the front side of the plane of FIG. 4 will be referred to as "forward" or "front side", and the direction toward the back side of the plane of FIG. 4 will be referred to as "backward" or "back side".

First, the exterior wall material 30 is fastened to the front sides of the column 22 and the stud 24 by using an appropriate method.

The exterior wall material 30 in the present embodiment has a so-called shiplap portion (i.e. a tongue portion), which is formed by cutting off substantially a half of the thickness of the exterior wall material 30, in each of the four side portions thereof. The shiplap portion serves as an overlapping portion for arranging adjacent exterior wall materials 30 so that end portions thereof overlap. In the present embodiment, the exterior wall material 30, which has a shiplap portion in each of the four side portions, has a so-called four-side shiplap structure. That is, the exterior wall material 30 has the lower shiplap portion 32 in an upper side portion thereof and has an upper shiplap portion (not shown) in a lower side portion thereof. The exterior wall material 30 respectively has an upper shiplap portion (not shown) and a lower shiplap portion (not shown) also in the left and right side portions thereof. Thus, it is possible to effectively suppress formation of a gap in the upper, lower, left, and right joints of the exterior wall materials 30, and the esthetic appearance is improved.

Figure 5:
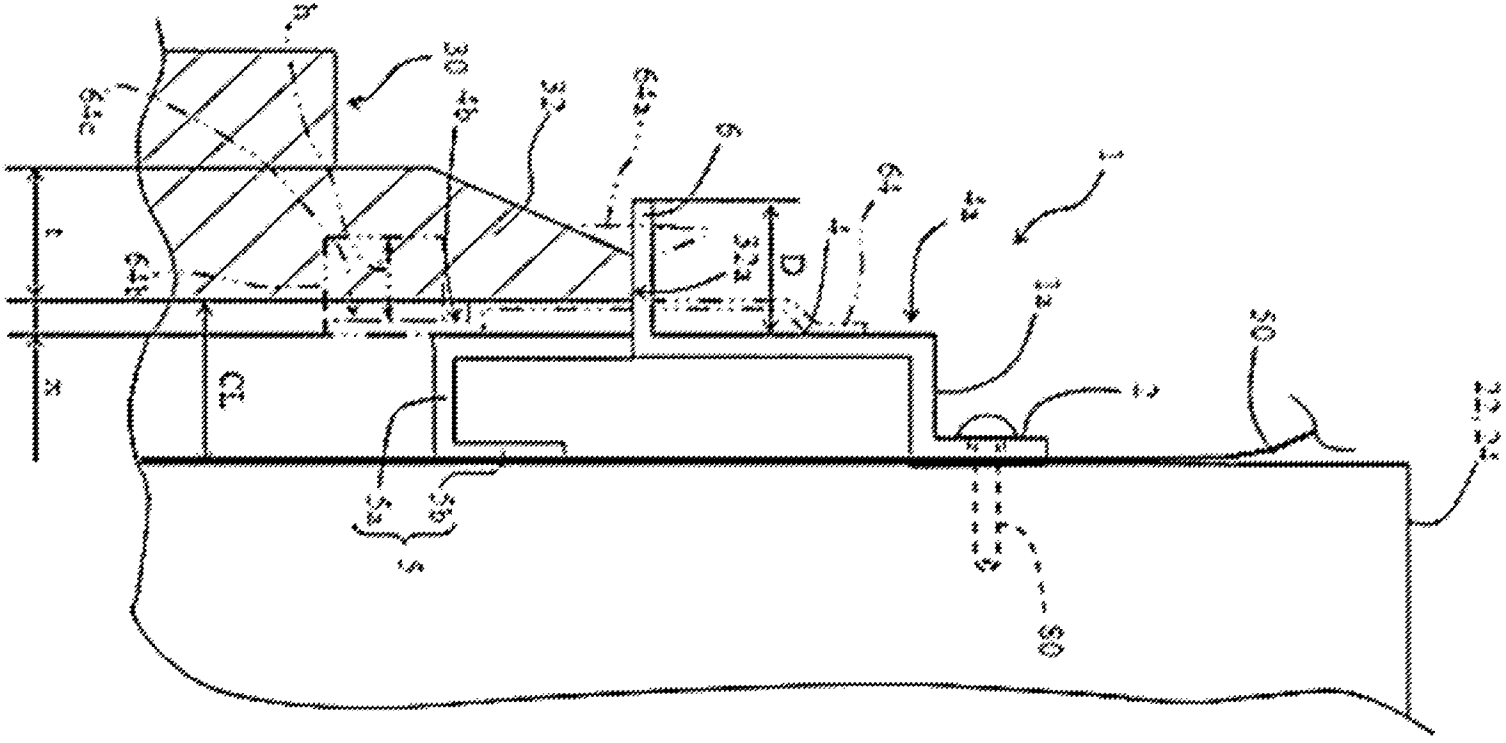
FIG. 5 is a side view illustrating a state in which the exterior wall material is fastened in place by using the auxiliary securing support according to the embodiment of the present invention, which is viewed in the direction of an arrow A in FIG. 1.
Figure 8:
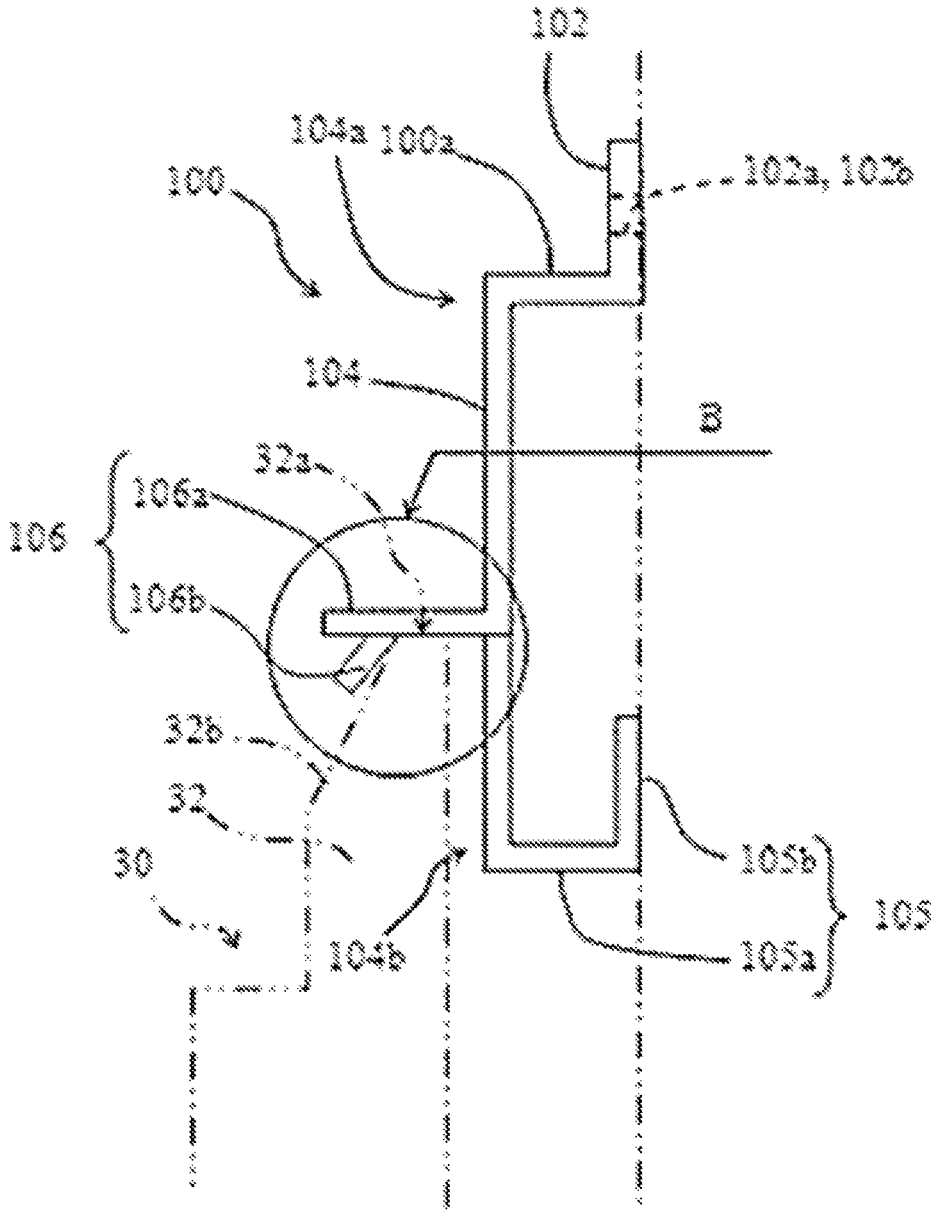
FIG. 8 is a side view illustrating the auxiliary securing support according to the first modification.

Referring to FIGS. 5 and 8, the lower shiplap portion 32 in the present embodiment has an upper end surface 32*a*, which is flat, at the upper end thereof, and an inclined surface 32*b* on the front side of the exterior wall material 30. Note that the shape of the shiplap portion is not limited to such a shape and can be any appropriate shape. For example, the shiplap portion may has an upper end surface, or has only an inclined surface while having substantially no flat surface at the upper end of the shiplap portion.

The column 22 and the stud 24 are examples of a "vertical frame member".

Next, at a position above the exterior wall material 30, which has been arranged to the column 22 and the stud 24, the auxiliary securing support 1 is attached and fixed to the column 22 and the stud 24 so as to extend between the column 22 and the stud 24. Referring to FIG. 5, it is possible to attach the auxiliary securing support 1 to the column 22 and the stud 24 by driving nails 80 or the like into the holes 2*a* while making the contact flat portion 2 and the second bent portion 5*b* be in contact with the column 22 and the stud 24. At this time, because three holes 2*a* are consecutively formed at the intervals p, it is easy to adjust the position of the auxiliary securing support 1 in the longitudinal direction (horizontal direction).

A waterproof sheet 50 is disposed between the auxiliary securing support 1 and the column 22 and the stud 24.

The nail 80 is an example of a "fastening member".

Figure 4:
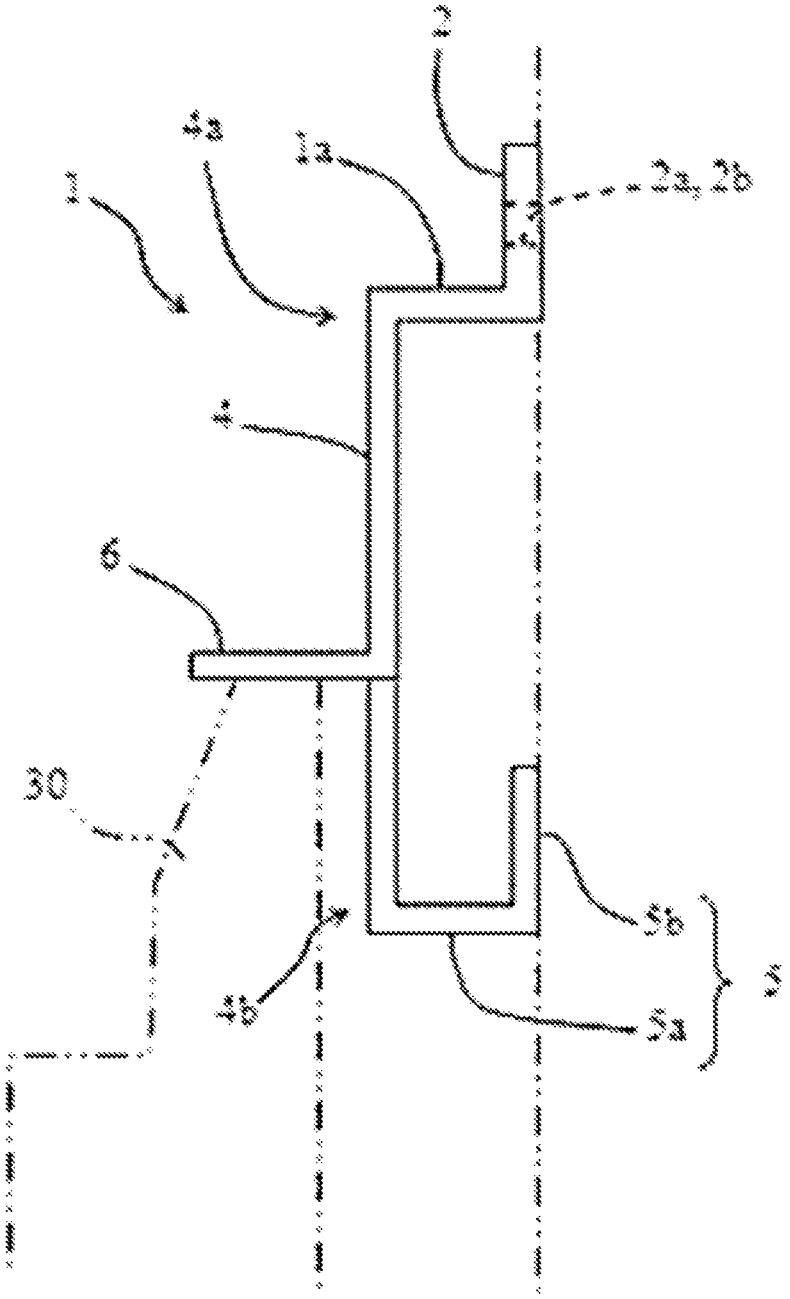
FIG. 4 is a view illustrating a state in which an exterior wall material is fastened in place by using the auxiliary securing support according to the embodiment of the present invention.

Referring to FIGS. 4 and 5, because the auxiliary securing support 1 has the protruding pieces 6, it is possible to attach the auxiliary securing support 1 to the column 22 and the stud 24 in a state in which the protruding pieces 6 are in contact with the upper end surface 32*a* of the lower shiplap portion 32, which is disposed in the upper end portion of the exterior wall material 30, that is, in a state in which the auxiliary securing support 1 is temporarily placed on the upper end surface 32*a* of the lower shiplap portion 32. Therefore, it is possible to improve workability and it is possible to horizontally fix the auxiliary securing support 1 to the column 22 and the stud 24 accurately. The upper end surface 32*a* of the lower shiplap portion 32 is an example of an "upper side portion of the exterior wall material" and a "horizontal surface portion".

As described above, the protruding pieces 6 are formed by cutting and bending up corners at both ends of the main flat portion 4 adjacent to the lower end portion 4*b*. Therefore, it is easy to form a structure for temporarily placing the auxiliary securing support 1 on the upper end surface 32*a* of the lower shiplap portion 32 while horizontally holding the auxiliary securing support 1 when fixing the auxiliary securing support 1 to the column 22 and the stud 24.

Referring to FIG. 5, a clearance CL is formed between the exterior wall material 30 and the column 22 and the stud 24 in consideration of ventilation and rainwater drainage. Therefore, when attaching the auxiliary securing support 1 to the column 22 and the stud 24, it is necessary to be careful not to drop the auxiliary securing support 1 into the clearance CL. With the present embodiment, it is possible to effectively prevent dropping of the auxiliary securing support 1 into the clearance CL due to the presence of the protruding pieces 6. Thus, it is possible to improve the workability of an operation of fixing the auxiliary securing support 1 to the column 22 and the stud 24.

Next, metal securing members 62 are made to engage with the lower shiplap portions 32 of the exterior wall materials 30 that are supported by the column 22 and the stud 24. In this state, the metal securing member 62 are attached and fixed to the main flat portion 4 of the auxiliary securing support 1 by using screws or the like (not shown).

At the left-right joint J between adjacent exterior wall materials 30 that is disposed between the column 22 and the stud 24, a metal securing member 64 is made to engage with the lower shiplap portions 32 of both of the left and right exterior wall materials 30, and the metal securing member 64 is attached and fixed to the main flat portion 4 of the auxiliary securing support 1 by using screws or the like (not shown). The metal securing members 62 and 64 are examples of a "securing member".

Figure 6:
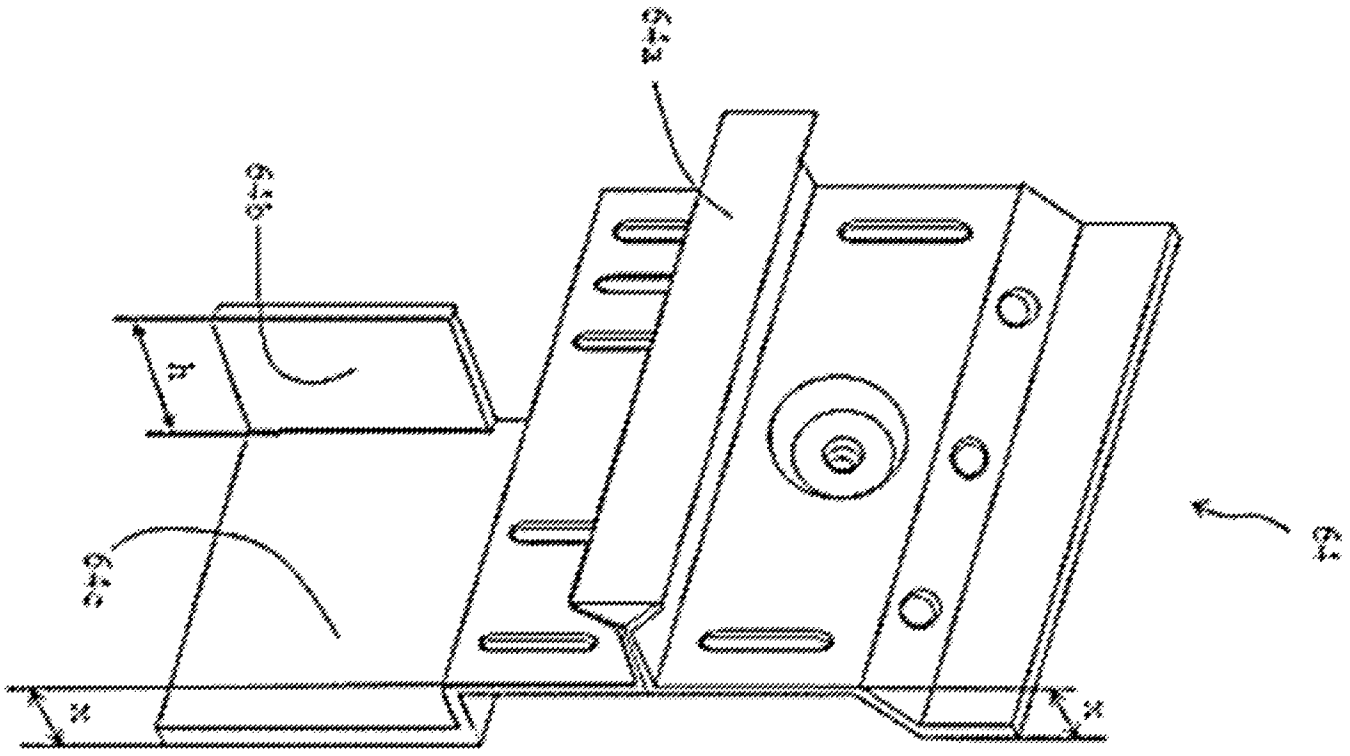
FIG. 6 is an external perspective view illustrating a metal securing member.

Referring to FIG. 6, the metal securing member 64 includes an engagement portion 64*a* for engaging the upper shiplap portion and the lower shiplap portion 32 of the exterior wall materials 30. An attachment hole 65 is formed at a position above the engagement portion 64*a* (in the upward direction from the engagement portion 64*a* in FIG. 6). A screw or the like, which is used to attach and fix the metal securing member 64 to the main flat portion 4 of the auxiliary securing support 1 as described above, is inserted into the attachment hole 65. The metal securing member 64 further includes a protruding plate portion 64*b* at a position below the engagement portion 64*a* (in the downward direction from the engagement portion 64*a* in FIG. 6). The protruding plate portion 64*b* protrudes in a direction the same as the protruding direction of the engagement portion 64*a*. The protruding plate portion 64*b* stands on a flat portion 64*c* at right angles to the flat portion 64*c*. Referring to FIG. 5, the height h of the protruding plate portion 64*b* (distance by which the protruding plate portion 64*b* protrudes from the flat portion 64*c*) is less than the thickness t of the lower shiplap portion 32 of the exterior wall material 30.

When the metal securing member 64, which is structured as described above, is used to engage the lower shiplap portions 32 of the left and right exterior wall materials 30, the protruding plate portion 64*b* is disposed in the left-right joint J of the exterior wall material 30. That is, the metal securing member 64 is disposed in such a way that the protruding plate portion 64*b* is sandwiched between the right end of the left exterior wall material 30 and the left end of the right exterior wall material 30. By disposing the metal securing member 64 in this way, it is possible to efficiently prevent displacement of the exterior wall material 30 in the left-right direction.

The structure of the metal securing member 62 is substantially the same as that of the metal securing member 64 shown in FIG. 6, except that the flat portion 64*c* and the protruding plate portion 64*b* are omitted. That is, the metal securing member 62 includes the engagement portion 64*a* for engaging the upper shiplap portion and the lower shiplap portion 32 of the exterior wall materials 30; and the attachment hole, which is formed in the metal securing member 62 at a position above the engagement portion 64*a*. A screw or the like for attaching and fixing the metal securing member 62 to the main flat portion 4 of the auxiliary securing support 1 is inserted into the attachment hole.

Thus, the left-right joint J of the exterior wall materials 30, which is located between the column 22 and the stud 24, is indirectly fastened to the column 22 and the stud 24 through the auxiliary securing support 1. Therefore, it is possible to secure the adjacent exterior wall materials 30 at the left-right joint J. Because the metal securing members 62 and 64, which are shorter than the auxiliary securing support 1, directly engage the exterior wall material 30, it is possible to increase the rigidity of attachment of the exterior wall material 30, compared with a structure in which the auxiliary securing support 1 directly engages the exterior wall material 30. Moreover, because it is possible to reduce a load due to an external force (such as wind pressure) applied to the auxiliary securing support 1 from the exterior wall material 30, it is possible to improve the durability of the auxiliary securing support 1.

Hereinafter, modifications of the present embodiment will be described.

In the above mentioned present embodiment, the protruding piece 6 comes into contact with only the upper end surface 32*a* of the lower shiplap portion 32. Alternatively, as in an auxiliary securing support 100 according to a first modification illustrated in FIGS. 7 to 9, a protruding piece 106 includes, in addition to a contact portion 106*a* that comes into contact with the upper end surface 32*a* of the lower shiplap portion 32, an engagement portion 106*b* that is engageable with the inclined surface 32*b* of the lower shiplap portion 32.

Figure 7:
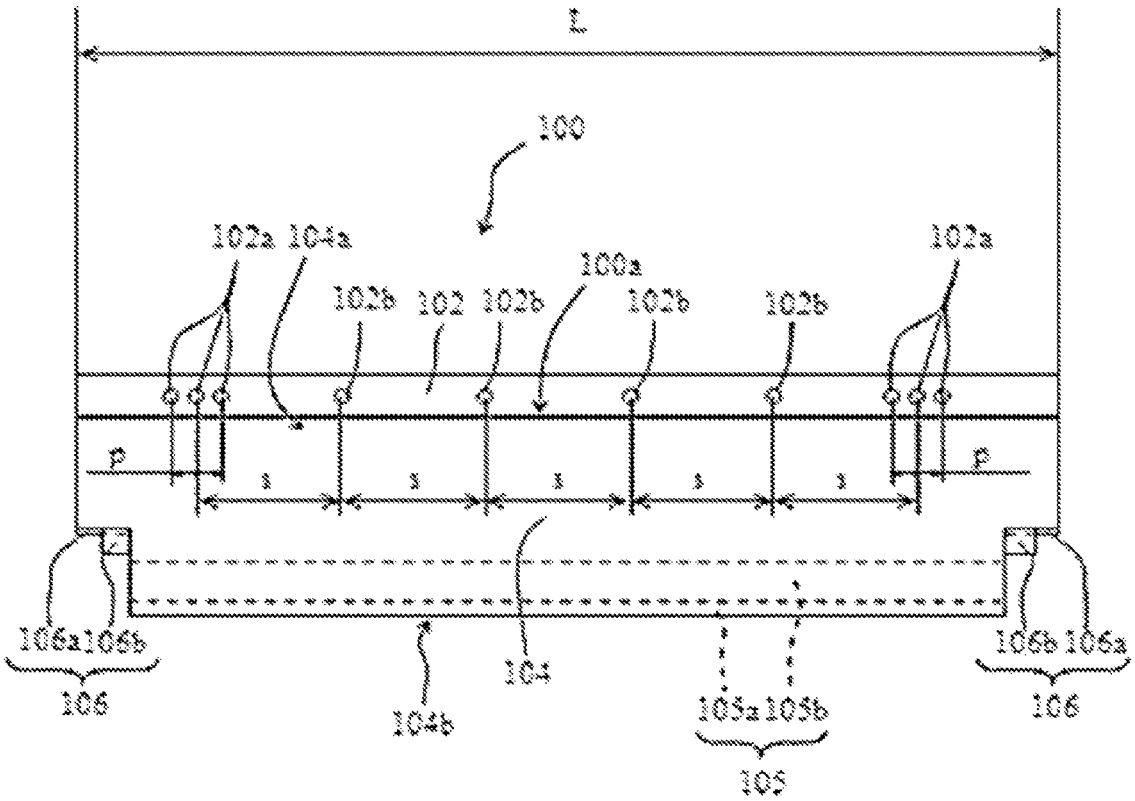
FIG. 7 is a front view illustrating an auxiliary securing support according to a first modification.
Figure 9:
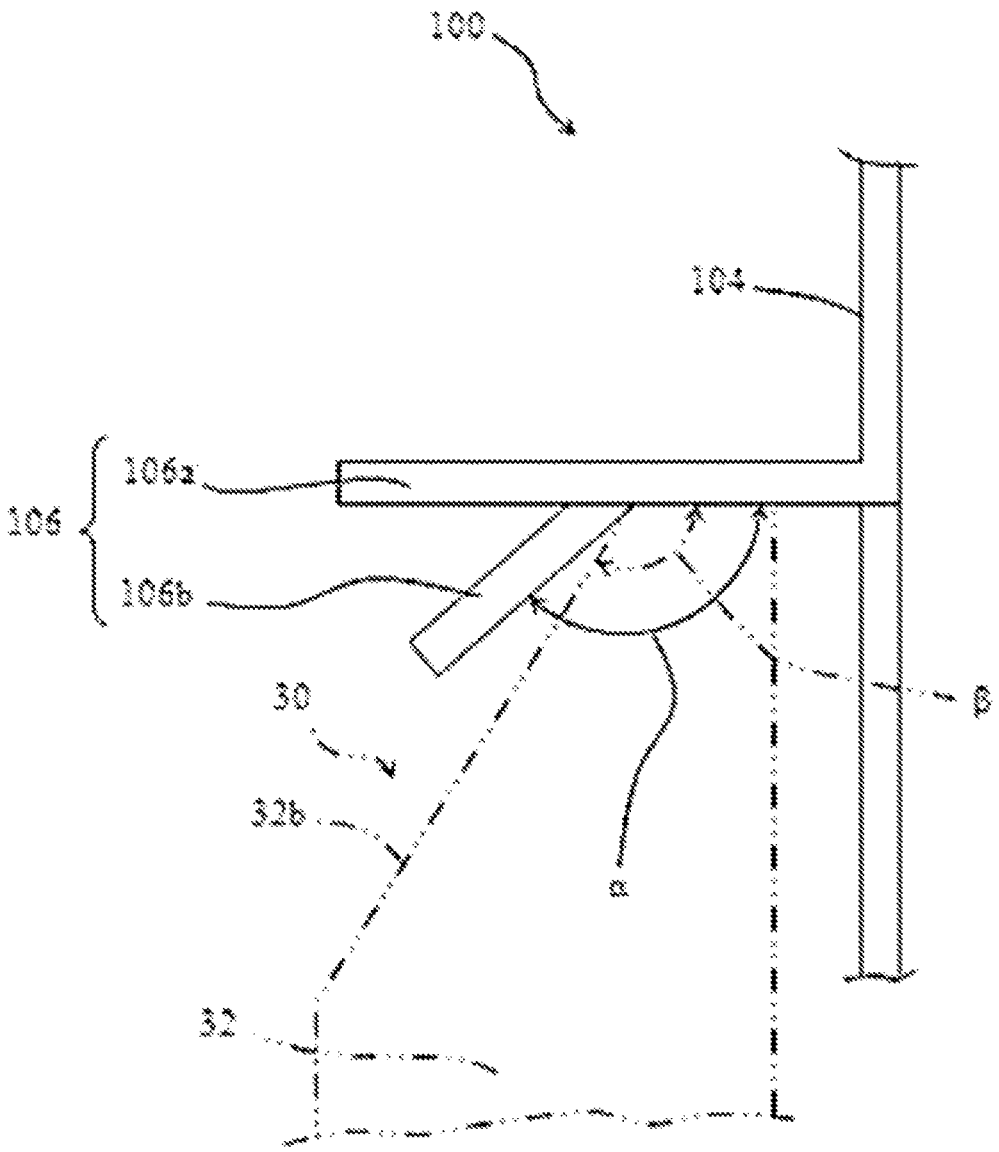
FIG. 9 is an enlarged view illustrating a region B of FIG. 8.

Referring to FIGS. 7 and 8, the engagement portion 106*b* is formed by bending a part of an end portion of the contact portion 106*a* toward a lower end portion 104*b* of a main flat portion 104. Referring to FIG. 9, the included angle $\alpha$ between the contact portion 106*a* and the engagement portion 106*b* is slightly greater than the included angle $\beta$ between the upper end surface 32*a* and the inclined surface 32*b* of the lower shiplap portion 32.

The inclined surface 32*b* is an example of an "inclined surface portion".

With this structure, it is possible to fix the auxiliary securing support 100 to the column 22 and the stud 24 in a state in which the engagement portion 106*b* of the protruding piece 106 is engaged with the lower shiplap portion 32. Therefore, it is possible to effectively prevent forward leaning of the auxiliary securing support 100 when the auxiliary securing support 100 is temporarily placed on the upper end surface 32*a* of the lower shiplap portion 32. Thus, it is possible to further improve the workability of the auxiliary securing support 100. Because the included angle $\alpha$ is slightly greater than the included angle $\beta$, it is easy to engage the engagement portion 106*b* with the lower shiplap portion 32 to effectively prevent forward leaning of the auxiliary securing support 100.

In the present embodiment and the first modification, the auxiliary securing supports 1 and 100 are attached to the column 22 and the stud 24. Alternatively, the auxiliary securing supports 1 and 100 can be attached to the column 22 and the stud 24 through a furring strip.

In the present embodiment and the first modification, the auxiliary securing supports 1 and 100 are attached to both of the column 22 and the stud 24 across the column 22 and the stud 24. Alternatively, the auxiliary securing supports 1 and 100 may be attached to only one of the column 22 and the stud 24.

In the present embodiment and the first modification, respectively, the protruding pieces 6 and 106 are formed by cutting and bending up corners at both ends of the main flat portions 4 and 104 adjacent to the lower end portions 4*b* and 104*b*. However, this is not a limitation. Alternatively, for example, the protruding pieces 6 and 106 can be respectively formed by cutting parts of the main flat portions 4 and 104, the parts being adjacent to the lower end portions 4*b* and 104*b* and near the centers of the main flat portions 4 and 104 in the longitudinal direction. Further alternatively, the protruding pieces 6 and 106 can be respectively formed by cutting and bending up the upper end portions 4*a* and 104*a* of the main flat portions 4 and 104. Further alternatively, the protruding pieces 6 and 106 can be respectively formed by cutting and bending up a part of the main flat portion 4 between the upper end portion 4*a* and the lower end portion 4*b*, or a part of the main flat portion 104 between the upper end portion 104*a* and the lower end portion 104*b* (middle parts of the main flat portions 4 and 104 in a direction perpendicular to the longitudinal direction).

In each of the present embodiment and the first modification, the number of the protruding pieces 6 and the number of the protruding pieces 106 are each two. However, this is not a limitation. For example, the number of the protruding pieces 6 and the number of the protruding pieces 106 each can be one, three, or more.

In the present embodiment and the first modification, respectively, the second bent portion 5*b* and a second bent portion 105*b* are bent at right angles from the first bent portion 5*a* and a first bent portion 105*a* toward the stepped portion 1*a* and a stepped portion 100*a*. Alternatively, the second bent portions 5*b* and 105*b* can be respectively bent at right angles in the opposite direction, that is, downward from the first bent portion 5*a* and 105*a* (in a direction away from the stepped portions 1*a* and 100*a*). Further alternatively, the second bent portions 5*b* and 105*b* can be omitted.

Figure 10:
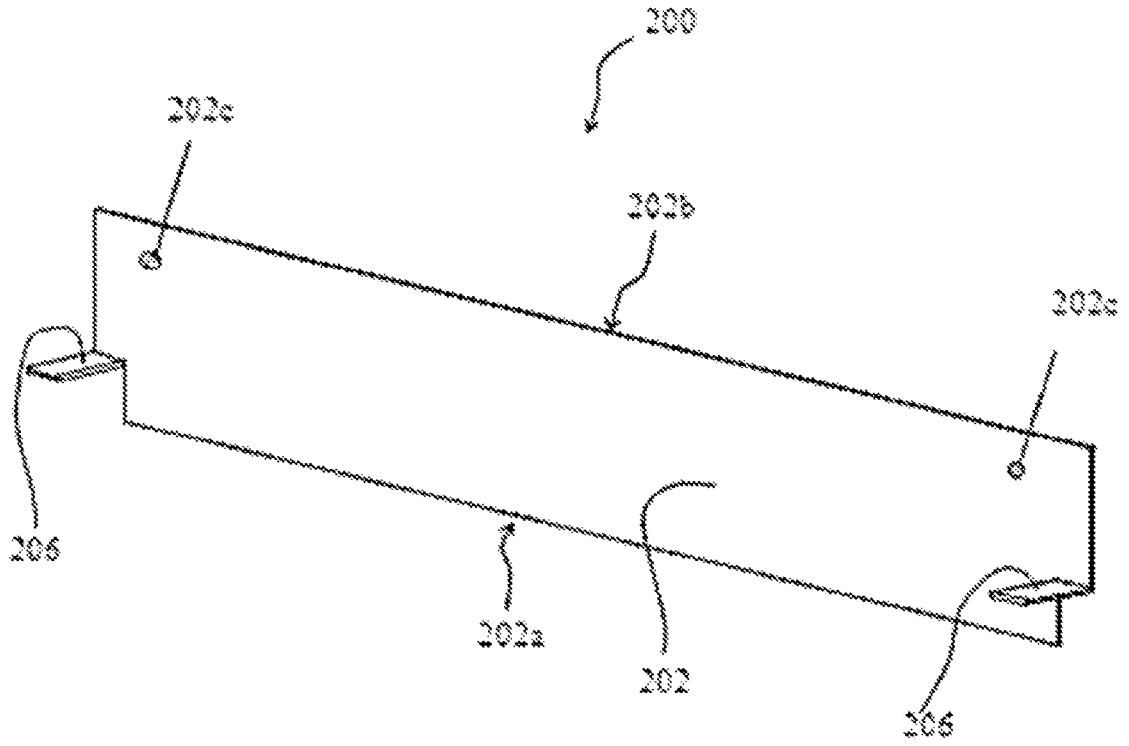
FIG. 10 is a schematic perspective view illustrating an auxiliary securing support according to a second modification.

In the present embodiment and the first modification, respectively, the auxiliary securing supports 1 and 100, which include the stepped portions 1*a* and 100*a*, have step-like shapes. Alternatively, as in an auxiliary securing support 200 according to a second modification shown in FIG. 10, the auxiliary securing support has a flat shape that does not have a stepped portion. In this case, the auxiliary securing support 200 includes a planar portion 202 and protruding pieces 206. The planar portion 202 has a single flat contact surface that comes into contact with the column 22 and the stud 24 and with the metal securing members 62 and 64. The protruding pieces 206 are formed by cutting and bending up corners at both ends of the planar portion 202 adjacent to a lower end portion 202*a*. Holes 202*c* are formed in the planar portion 202 at positions that are adjacent to the upper end portion 202*b* and near both ends of the planar portion 202 in the longitudinal direction. By driving nails or the like into the holes 202*c*, it is possible to attach the auxiliary securing support 200 to the column 22 and the stud 24.

In the present embodiment, the auxiliary securing support is used to attach the exterior wall material 30 having the four-side shiplap structure, in which shiplap portions are formed in the four side portions of the exterior wall material 30. However, this is not a limitation. Alternatively, for example, the auxiliary securing support is possible to be used to attach an exterior wall material 30 having simple flat side surfaces, in which shiplap portions are formed in only upper and lower end portions but are not formed in the left and right end portions of the exterior wall material 30. In this case, the left and right side surfaces of the exterior wall material 30 are just brought into contact with each other. In this case, at a position on the auxiliary securing support 1 corresponding to the left-right joint J, a decorative member (joiner) for forming the joint bottom can be attached. By applying a sealant from an opening of the left-right joint J of the exterior wall materials 30 toward a joint bottom backed by the decorative member, it is possible to fill a gap formed in the left-right joint J with the sealant.

The present embodiment is an example of an embodiment of the present invention. Accordingly, the present invention is not limited to the structure of the present embodiment.

What is claimed is:

1. An auxiliary securing support for attaching an exterior wall material to a building frame having a plurality of vertical frame members through a securing member, the auxiliary securing support comprising:

a main body that has an elongated shape, that includes a continuous uninterrupted planar portion to which the securing member is fixable, and that is fixable to at least one of the vertical frame members; and at least two protrusions, each protrusion that protrudes in a direction crossing the continuous uninterrupted planar portion so as to come into contact with an upper side portion of the exterior wall material and that has a length such that the protrusion is not exposed on an external surface of the exterior wall material, wherein the continuous uninterrupted planar portion is located between the protrusions, wherein the main body includes a first flat portion that comes into contact with the vertical frame member, a second flat portion that includes the continuous uninterrupted planar portion and that is disposed parallel to the first flat portion, and a connection portion that connects the first and second flat portions in a stepped shape, wherein the connection portion is structured so that the second flat portion is located away from the first flat portion in a direction that is the same as a protruding direction of said at least two protrusions, and wherein said at least two protrusions are provided on the second flat portion.

2. The auxiliary securing support according to claim 1, wherein at least one of said at least two protrusions comes into contact with an upper end portion of a shiplap portion of an upper side portion of the exterior wall material.

3. The auxiliary securing support according to claim 2, wherein each of said at least two protrusions includes a planar member that protrudes from the main body in a direction perpendicular to the main body so as to be capable of coming into contact with a planar portion of the upper end portion of the shiplap portion provided in the upper side portion of the exterior wall material.

4. The auxiliary securing support according to claim 1, wherein each of said at least two protrusions is disposed on each of two end portions of the main body in the longitudinal direction.

5. The auxiliary securing support according to claim 1, wherein each of said at least two protrusions is formed by cutting and bending up a part of the main body.

6. The auxiliary securing support according to claim 1, wherein each of said at least two protrusions is inclined so as to be capable of being fitted with an inclined surface portion provided in a shiplap portion of an upper side portion of the exterior wall material.

7. The auxiliary securing support according to claim 1, wherein each of said at least two protrusions includes a contact portion that comes into contact with a horizontal surface portion of a shiplap portion of the exterior wall material and an engagement portion that is capable of engaging an inclined surface portion of the shiplap portion of the exterior wall material, and wherein an included angle between the contact portion and the engagement portion is greater than an included angle between the horizontal surface portion and the inclined surface portion.

8. The auxiliary securing support according to claim 7, wherein the engagement portion is formed by bending a part of the contact portion downward.

9. A method of installing an auxiliary securing support for attaching an exterior wall material to a building frame having a plurality of vertical frame members through a securing member, the method comprising:

providing the auxiliary securing support according to claim 1;

temporarily placing the auxiliary securing support so that at least one of said at least two protrusions is in contact with the upper side portion of the exterior wall material, which has been placed beforehand;

fixing the main body of the auxiliary securing support, which has been temporarily placed, to at least one of the vertical frame members by using a fastening member; and fixing the securing member to the continuous uninterrupted planar portion.

10. An auxiliary securing support that is capable of indirectly attaching a joint between adjacent exterior wall materials to a vertical frame member through a securing member in a case where the joint is located in a region of a building frame in which the vertical frame member is not disposed, the auxiliary securing support comprising:

a main body that has an elongated shape, that includes a continuous uninterrupted planar portion to which the securing member is fixable, and that is fixable to the vertical frame member; and at least two protrusions, each protrusion that protrudes in a direction crossing the main body so as to come into contact with an upper side portion of the exterior wall material, which is disposed on an upper side of the exterior wall material in a vertical direction, when the exterior wall material is fixed to the vertical frame member, wherein the continuous uninterrupted planar portion is located between the protrusions, wherein the main body includes a first flat portion that comes into contact with the vertical frame member, a second flat portion that includes the continuous uninterrupted planar portion and that is disposed parallel to the first flat portion, and a connection portion that connects the first and second flat portions in a stepped shape, wherein the connection portion is structured so that the second flat portion is located away from the first flat portion in a direction that is the same as a protruding direction of said at least two protrusions, and wherein said at least two protrusions are provided on the second flat portion.

11. The auxiliary securing support according to claim 10, wherein each of said at least two protrusions is disposed on each of two end portions of the main body in the longitudinal direction.

12. The auxiliary securing support according to claim 10, wherein each of said at least two protrusions is formed by cutting and bending up a part of a lower end portion of the main body, which is disposed on a lower side of the main body in the vertical direction when the main body is fixed to the vertical frame member.

13. The auxiliary securing support according to claim 10, wherein each of said at least two protrusions is engageable with the exterior wall material.

14. The auxiliary securing support according to claim 13, wherein the upper side portion of the exterior wall material includes a horizontal surface portion having a flat surface that extends substantially horizontally when the exterior wall material is attached to the vertical frame member and an inclined surface portion having a surface that is inclined with respect to the horizontal surface portion, wherein each of said at least two protrusions includes a contact portion that comes into contact with the horizontal surface portion and an engagement portion that is capable of engaging the inclined surface portion, and wherein an included angle between the contact portion and the engagement portion is greater than an included angle between the horizontal surface portion and the inclined surface portion.

15. The auxiliary securing support according to claim 14, wherein the engagement portion is formed by bending a part of the contact portion downward.

16. A method of installing an auxiliary securing support for indirectly fastening a joint between adjacent exterior wall materials to a vertical frame member of a building frame through a securing member, the joint being disposed in a region of the building frame in which the vertical frame member is not disposed, the method comprising:

providing the auxiliary securing support according to claim 10;

temporarily placing the auxiliary securing support so that at least one of said at least two protrusions is in contact with the upper side portion of the exterior wall material, which is disposed on the upper side of the exterior wall material arranged to the vertical frame member;

adjusting a position of the auxiliary securing support in a horizontal direction so that the main body is located at a position at which the auxiliary securing support extends across the joint of the exterior wall materials; and fixing the auxiliary securing support to the vertical frame member by using a fastening member.

17. An auxiliary securing supporting structure for attaching an exterior wall material to a building frame having a plurality of vertical frame members through, the auxiliary securing support structure comprising:

an auxiliary securing support; and a securing member, wherein the auxiliary securing support comprises:

a main body that has an elongated shape, that includes a continuous uninterrupted planar portion to which the securing member is fixable, and that is fixable to at least one of the vertical frame members; and at least two protrusions, each protrusion that protrudes in a direction crossing the continuous uninterrupted planar portion so as to come into contact with an upper side portion of the exterior wall material and that has a length such that the protrusion is not exposed on an external surface of the exterior wall material, wherein the continuous uninterrupted planar portion is located between the protrusions, and the securing member is disposed on the continuous uninterrupted planar portion of the auxiliary securing support so as to hold the exterior wall material.

18. An exterior wall supporting structure for attaching an exterior wall material to a building frame having a plurality of vertical frame members through a securing member, the exterior wall supporting structure comprising:

a plurality of vertical frame members of a building frame;

an exterior wall material;

an auxiliary securing support disposed between the vertical frame members; and a securing member disposed on the auxiliary securing support, wherein the auxiliary securing support comprises:

a main body that has an elongated shape, that includes a continuous uninterrupted planar portion to which the securing member is fixable, and that is fixable to at least one of the vertical frame members; and at least two protrusions, each protrusion protrudes in a direction crossing the continuous uninterrupted planar portion so as to come into contact with an upper side portion of the exterior wall material and that has a length such that the protrusion is not exposed on an external surface of the exterior wall material, wherein the continuous uninterrupted planar portion is located between the protrusions, and the securing member is disposed on the continuous uninterrupted planar portion of the auxiliary securing support so as to hold the exterior wall material, and the exterior wall material is fixed by the securing member.

* * * * *